US006913090B2

(12) United States Patent
Droste et al.

(10) Patent No.: US 6,913,090 B2
(45) Date of Patent: Jul. 5, 2005

(54) HAMMER

(75) Inventors: Manfred Droste, Limburg-Offheim (DE); Rainer Herting, Langenhahn (DE)

(73) Assignee: Black & Decker Inc., Newark, DE (US)

( * ) Notice: Subject to any disclaimer, the term of this patent is extended or adjusted under 35 U.S.C. 154(b) by 75 days.

(21) Appl. No.: 10/691,246

(22) Filed: Oct. 22, 2003

(65) Prior Publication Data

US 2004/0211574 A1 Oct. 28, 2004

(30) Foreign Application Priority Data

Oct. 23, 2002 (GB) ..... 0224638

(51) Int. Cl.[7] ..... B25D 11/00

(52) U.S. Cl. ..... 173/109; 173/48; 173/104; 192/223.2; 475/900

(58) Field of Search ..... 173/48, 104, 109, 173/201, 216; 70/182, 190; 192/38, 53, 53.36, 223, 223.2; 475/900

(56) References Cited

U.S. PATENT DOCUMENTS

| | | | | |
|---|---|---|---|---|
| 3,794,124 A | | 2/1974 | Biersack | |
| 3,809,168 A | | 5/1974 | Fromm | |
| 4,236,588 A | | 12/1980 | Moldan et al. | |
| 4,309,062 A | | 1/1982 | Bischoff | |
| 4,446,931 A | | 5/1984 | Bleicher et al. | |
| 4,506,743 A | | 3/1985 | Grossmann | |
| 4,537,264 A | | 8/1985 | Schmid et al. | |
| 4,895,212 A | | 1/1990 | Wache | |
| 4,898,250 A | * | 2/1990 | Neumaier et al. | 173/48 |
| 4,971,156 A | | 11/1990 | Wong | |
| 5,020,385 A | | 6/1991 | Bader | |
| 5,070,982 A | | 12/1991 | Pitchford | |
| 5,111,889 A | | 5/1992 | Neumaier | |
| 5,111,890 A | | 5/1992 | Ranger et al. | |
| 5,169,245 A | | 12/1992 | Harada et al. | |
| 5,243,866 A | | 9/1993 | Mayer | |
| 5,320,177 A | | 6/1994 | Shabita et al. | |
| 5,343,961 A | | 9/1994 | Ichikawa | |
| 5,379,848 A | | 1/1995 | Rauser | |
| 5,456,324 A | | 10/1995 | Takagi et al. | |
| 5,842,527 A | | 12/1998 | Arakawa et al. | |
| 5,848,643 A | | 12/1998 | Carbaugh et al. | |
| 6,010,426 A | * | 1/2000 | Nakamura | 477/22 |
| 6,015,017 A | | 1/2000 | Lauterwald | |
| 6,035,945 A | | 3/2000 | Ichijyou et al. | |
| 6,131,671 A | * | 10/2000 | Shibata et al. | 173/48 |
| 6,192,996 B1 | | 2/2001 | Sakaguchi et al. | |
| 6,223,833 B1 | | 5/2001 | Thurler et al. | |
| 6,237,699 B1 | | 5/2001 | Pleitcsh et al. | |
| 6,666,284 B2 | * | 12/2003 | Stirm | 173/97 |
| 6,698,530 B2 | * | 3/2004 | Hecht | 173/48 |
| 6,702,090 B2 | * | 3/2004 | Nakamura et al. | 192/223.2 |

FOREIGN PATENT DOCUMENTS

| | | |
|---|---|---|
| GB | 1576795 | 10/1980 |

* cited by examiner

*Primary Examiner*—Stephen F. Gerrity
*Assistant Examiner*—Gloria R. Weeks
(74) *Attorney, Agent, or Firm*—Michael P. Leary; Charles E. Yocum; Adan Ayala

(57) ABSTRACT

A hand-held powered hammer comprising a hammer housing; a hammering mechanism; a spindle rotatably mounted within the housing; the spindle having a first mode of operation in which the spindle is rotatable within the housing and a second mode of operation in which the spindle is restrained from rotation; a first set of teeth rotatable with the spindle and selectably movable between a first position and a second position, corresponding to the second mode of operation of the spindle; a spindle lock arrangement mounted within the housing and comprising a spindle lock tooth engageable with the first set of teeth when the first set of teeth are in the second position, and a resilient synchronising element positioned to engage the first set of teeth before the first set of teeth reaches the second position, so as to align the first set of teeth for engagement with the spindle lock tooth.

16 Claims, 3 Drawing Sheets

HAMMER

This invention relates to hand-held powered hammers, in particular electrically powered rotary hammers having an air cushion hammering mechanism. More particularly, it relates to a spindle lock mechanism for such tools.

BACKGROUND OF THE INVENTION

Rotary hammers are known which have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more cylindrical parts, which together form the hammer spindle. For example, a front part of the spindle may be formed as a separate tool holder body for retaining the tool or bit. Such hammers are generally provided with an impact mechanism which converts the rotational drive from an electric motor to a reciprocating drive causing a piston, which may be a hollow piston, to reciprocate within the spindle. The piston reciprocatingly drives a ram by means of a closed air cushion located between the piston and the ram. The impacts from the ram are transmitted to the tool or bit of the hammer, optionally via a beatpiece.

Some hammers can be employed in combination impact and drilling mode or in a drilling only mode in which the spindle, or a forwardmost part of the spindle, and hence the bit inserted therein will be caused to rotate. In the combination impact and drilling mode the bit will be caused to rotate at the same time as the bit receives repeated impacts. Such hammers generally have a hammer only mode in which the spindle is locked against rotation.

In some known designs of rotary hammer, for example in DE27 28 961, an axially moveable spindle drive gear may be mounted non-rotatably around the spindle. The axial position of the spindle drive gear is selected via a mode change mechanism actuated by a mode change knob. In a first axial position the gear engages an intermediate drive shaft in order to transfer rotary drive from the intermediate drive shaft to the hollow spindle. The first axial position is a hammer drilling or drilling only mode of the hammer. In a second axial position the gear is disengaged from the intermediate drive shaft and so no longer transfers said rotary drive. In the second position the gear engages a set of spindle lock teeth fixed inside the housing of the hammer, so as to rotationally fix the gear and thereby the spindle in the housing. The second position is a hammer only mode of the hammer.

One problem with such mode change mechanisms is gear synchronisation. In order to overcome this problem the gear may be biased into its first position, so that when the sleeve or gear is moved into the first position towards the intermediate drive shaft, if the sets of teeth on the gear and on the drive shaft are mis-aligned, as soon as the hammer is turned on and the drive shaft begins to rotate, the sets of teeth are brought into engagement by the biasing means as soon as the sets of teeth become aligned. Thus, it is relatively easy to overcome this synchronisation problem on entry into a rotary mode of the hammer.

When the sleeve or gear is moved into its second position, if the sets of teeth on the gear and on the spindle lock teeth are not aligned, they will not engage. This problem can be reduced to some extent by chamfering the sets of teeth. However, some manual adjustment of the rotational position of the spindle by a user is often required to bring the sets of teeth into engagement so that the spindle is locked.

BRIEF DESCRIPTION OF THE INVENTION

The present invention aims to provide a hammer arrangement with an effective design of spindle lock arrangement for hammering mode which enables automatic engagement of a spindle drive teeth with a set of spindle lock teeth, without a user having to manually adjust the rotational position of the spindle.

According to the present invention there is provided a hand-held powered hammer comprising:

a hammer housing;

a spindle rotatably mounted within the housing;

a hammering mechanism for generating repeated impacts on a tool or bit mounted at the forward end of the spindle;

a spindle lock arrangement, comprising at least one spindle lock tooth, which arrangement is mounted within the housing; and a set of teeth arranged for rotation with the spindle;

wherein the hammer has at least two modes including a first mode in which the spindle is rotatable within the housing and a second mode in which the set of teeth engage the spindle lock tooth or teeth so as to lock the spindle against rotation within the housing;

characterised in that the spindle lock arrangement comprises a resilient synchronising element positioned to engage the set of teeth before the spindle lock tooth or teeth engage the set of teeth on movement from the first mode to the second mode so as to bring the set of teeth into meshing alignment with spindle lock tooth or teeth.

Thus, an improved spindle lock arrangement is provided in which a resilient synchronising element engages the set of teeth as the hammer is moved towards its second mode. The synchronising element is able to deform or move in order to engage the set of teeth and then, because it is resilient, the synchronising element then moves back to its original position or state in order to rotate the set of teeth into a meshing alignment with the spindle lock tooth or teeth. Therefore, as the hammer is moved into its second mode the set of teeth are automatically aligned with the spindle lock tooth or teeth. Accordingly, the user will not generally need to manually rotate the spindle in order to bring the teeth into meshing alignment. As soon as the set of teeth and the spindle lock tooth or teeth are in meshing engagement the spindle is locked in the hammer housing against rotation and second mode of the hammer is achieved.

To facilitate the synchronisation of the set of teeth by engagement with the synchronising element the teeth are preferably chamfered. The teeth are chamfered so that they taper to a reduced width towards their ends. The chamfering of the teeth results in adjacent teeth having facing surfaces which slope away from each other. The synchronising element engages one or more of the sloping surfaces, and a biasing force from the synchronising element due to the resilient characteristic of the synchronising element causes the synchronising element to move towards the root of each tooth along the sloping surface and so push the tooth to one side, causing the set of teeth to move into a position in which they are meshingly aligned with the spindle lock tooth or teeth. To achieve this the synchronising element is located on the spindle lock arrangement so as to be aligned with a position of a spindle lock tooth or a position where an additional spindle lock tooth suitable for engaging the set of teeth would be located, in addition to the spindle lock tooth or teeth.

The hammer may be a rotary hammer with the set of teeth forming part of a gear train for transmitting rotary drive to the spindle in the first mode. In this case an overload clutch arrangement may be provided via which rotary drive is transmitted from the set of teeth to the spindle. In one embodiment the set of teeth are formed on a gear, which gear is mounted around the spindle. The set of teeth may be slideably moveable into engagement with the spindle lock tooth or teeth or alternatively, the spindle lock arrangement may be slideably moveable to bring the spindle lock tooth or teeth into engagement with the set of teeth.

In one embodiment the resilient synchronising element comprises an engaging element slideably mounted on the spindle lock arrangement and a spring element for resiliently biasing the engaging element into a position in which the engaging element is engageable with the set of teeth. The engaging element may be slideably mounted within a recess formed in the spindle lock arrangement and biased into a position in which the engaging element protrudes from an entrance to the recess so as to be engageable with the set of teeth. In one embodiment the engaging element is a resiliently biased ball biased into its engaging position by a spring element.

The spindle lock arrangement according to the present invention may have a dual function of locking the spindle against rotation and of axially biasing the intermediate shaft rearwardly, in which case the spindle lock arrangement is located at the forward end of the intermediate shaft and may additionally include a second resilient element positioned to engage the forward end of the intermediate shaft so as to bias the intermediate shaft rearwardly within the housing. The second element may act to bias the intermediate shaft in a direction substantially perpendicular to the direction in which the synchronising element acts to engage the set of teeth.

BRIEF DESCRIPTION OF THE DRAWINGS

An embodiment of a hammer according to the present invention will now be described by way of example, with reference to the accompanying drawings in which.

DETAILED DESCRIPTION OF THE INVENTION

Figure 1:
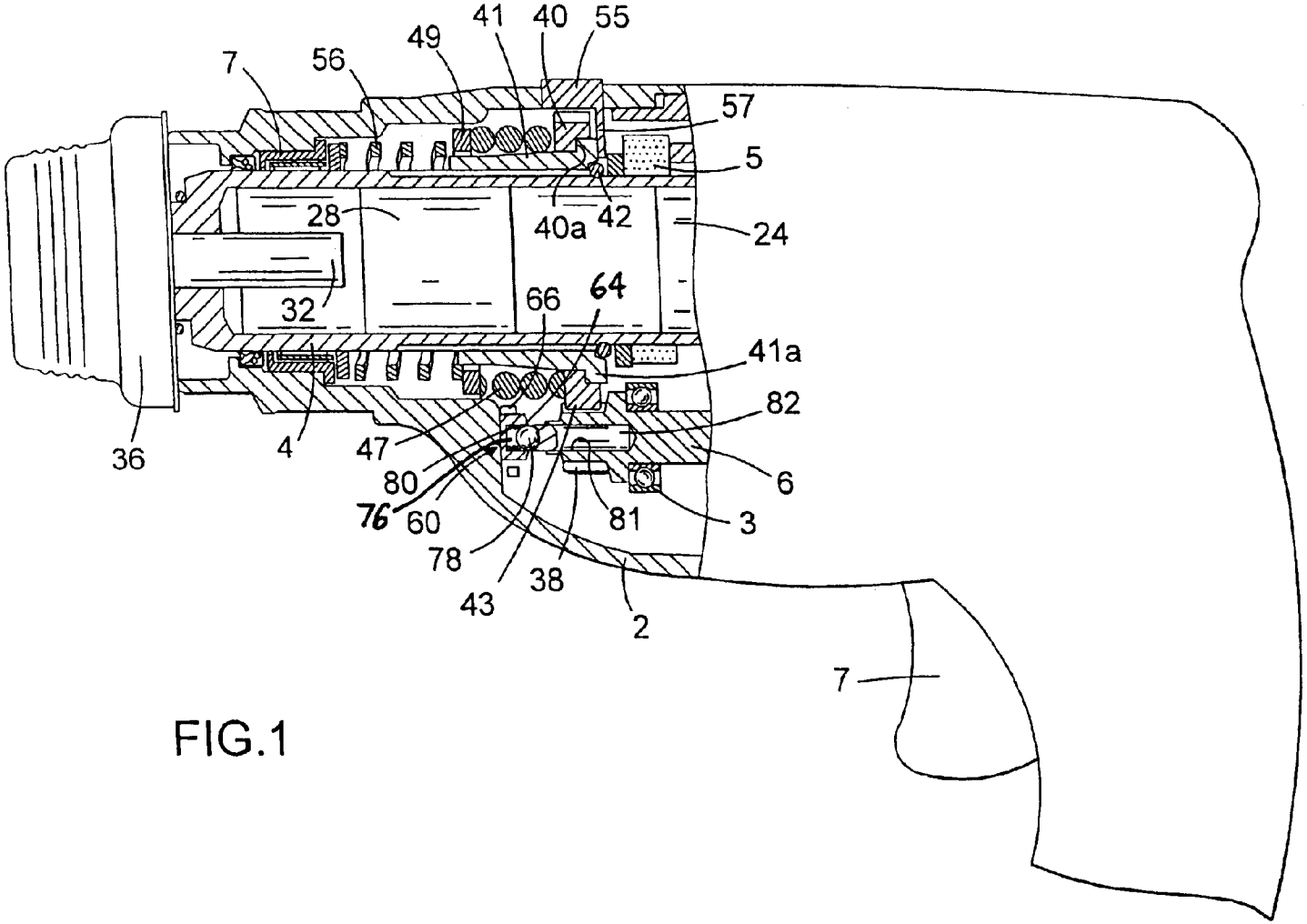
FIG. 1 is a partially cut away side cross-sectional elevation of a rotary hammer according to the present invention.

The rotary hammer has a forward portion which is shown cross-section in FIG. 1 and a rearward portion incorporating a motor and a pistol grip rear handle (shown cut away), in the conventional way. Alternatively, the handle may be of the D-handle type. The handle portion incorporates a trigger switch (7) for actuating the electric motor, which motor is formed at the forward end of its armature shaft with a pinion. The pinion of the motor rotatingly drives an intermediate shaft (6) via a gear which gear is press fit onto the rearward end of the intermediate shaft (6). The intermediate shaft is rotatingly mounted in the housing (2) of the hammer via a first bearing located at the rearward end of the intermediate shaft (6) and a forward bearing (3) located at the forward end of the intermediate shaft (6).

A wobble drive hammering mechanism, of a type that is well known in the art, is provided for reciprocatingly driving a piston (24). The piston (24) is slideably located within the hollow cylindrical spindle (4) and an O-ring seal is mounted around the piston (24) so as to seal between the periphery of the piston (24) and the internal surface of the spindle (4). A ram (28) is slideably mounted within the spindle (4) and an O-ring seal is mounted around the ram (28) so as to seal between the periphery of the ram (28) and the internal surface of the spindle (4). During normal operation of the hammer, a closed air cushion is formed between the forward face of the piston (24) and the rearward face of the ram (28) and so the ram is reciprocatingly driven by the piston via the closed air cushion. During normal operation of the hammer the ram (28) repeatedly impacts a beapiece (32), which beatpiece is reciprocatingly mounted within the spindle (4). The beatpiece (32) transfers impacts from the ram (28) to a tool or bit (not shown) mounted within a forward tool holder portion of the spindle (4) by a tool holder arrangement (36), of a type known in the art. The tool or bit is releasably locked within the tool holder portion of the spindle (4) so as to be able to reciprocate within the tool holder portion of the spindle by a limited amount.

The spindle (4) is rotatably mounted in the hammer housing (2) via bearings (5, 7). Simultaneously with, or as an alternative to, the hammering action generated by the hammering mechanism described above, the spindle (4) can be rotatingly driven by the intermediate shaft (6), as described below. Thus, as well as reciprocating, the tool or bit is rotatingly driven because it is non-rotatably mounted within the spindle by the tool holder arrangement (36).

A spindle drive gear (40) is rotatably and axially slideably mounted on a slider sleeve (41). The slider sleeve (41) is non-rotatably and axially slideably mounted on the spindle (4). The spindle drive gear is formed on its periphery with a set of teeth (43). The intermediate shaft (6) is formed at its forward end with a pinion (38) and the teeth (43) of the spindle drive gear may be brought into engagement with the pinion (38) in order to transmit rotary drive to the slider sleeve (41) and thereby to the spindle (4). The spindle drive gear (40) transmits rotary drive to the slider sleeve (41) via an overload clutch arrangement. The spindle drive gear (40) has a set of rearwardly facing teeth **(40*a*) formed on the rearward half of its radially inward facing face. This set of teeth is biased into engagement with a set of forwardly facing teeth formed on an annular flange (41*a*) of the slider sleeve (41). The sets of teeth are biased into engagement with each other by a spring (47), which spring is mounted on the slider sleeve (41) to extend between a washer (49) axially fixedly mounted at the forward end of the slider sleeve (41) and the forward facing face of the spindle drive gear (40)**.

Thus, with the slider sleeve in the position shown in FIG. 1, when the torque required to rotationally drive the spindle (4) is below a predetermined threshold, the spring (47) biases the sets of facing teeth on the spindle drive gear (40) and the slider sleeve (41) into engagement. With the sets of facing teeth engaged, rotation of the intermediate shaft (6) rotationally drives the spindle drive gear (40) via pinion (38), the spindle drive gear (40) rotationally drives the slider sleeve (41) via the interlocking facing teeth and the slider sleeve (41) rotationally drives the hollow cylindrical spindle (4) on which it is non-rotatably mounted. However, when the torque required to rotationally drive the spindle (4) exceeds a predetermined torque threshold the spindle drive gear (40) can move forwardly along the slider sleeve (41) against the biasing force of the spring (47). Thus, the spindle drive gear (40) begins to slip relative to the slider sleeve (41) and the sets of facing teeth ratchet over each other, and so the rotary drive from the spindle drive gear (40) is not transmitted to the spindle (4). The ratcheting of the sets of teeth makes a noise which alerts the user of the hammer to the fact that the overload clutch arrangement (40, 41, 47) is slipping.

The slider sleeve (41) is axially biased by a spring (56) into a rearward position, as shown in FIG. 1, against an axial stop formed by circlip (42), which circlip is mounted in a recess formed in the external surface of the spindle (4). In the rearward position, the hammer is in a rotary mode and rotation from the intermediate shaft (6) will be transmitted to the spindle (4), provided the torque transmitted is below the threshold torque of the overload clutch. The slider sleeve (41) can be moved into a forward position against the biasing force of the spring (56) via a mode change mechanism. In the forward position the spindle drive gear (40) is moved on the slider sleeve (41) forwardly out of engagement with the intermediate shaft pinion (38) and into engagement with a spindle lock arrangement (60) described below. With the slider sleeve (41) and spindle drive gear in a forward position, the hammer is in a non-rotary mode with the spindle (4) fixed against rotation, as will be described below. The mode change arrangement may comprise a mode change knob (55) rotatably mounted on the housing (2) and having an eccentric pin (57) which is engageable with the rearward face of the annular flange (41*a*) of the slider sleeve (41) to move the slider sleeve forwardly. In the position shown in FIG. 1, the spring (56) biases the slider sleeve into its rearward position. However, on rotation of the mode change knob, from its FIG. 1 position through 180° the eccentric pin will move the slider sleeve (41) forwardly against the biasing force of the spring (56). The eccentric pin (57) will move the slider sleeve forwardly to move the spindle drive gear (40) out of engagement with the pinion (38) of the intermediate shaft (6) and into engagement with the spindle lock arrangement (60).

Alternatively, a mode change mechanism with a mode change linkage acting on the slider sleeve (41) can be used, in which a mode change knob is used to move a pair of mode change linkage for actuating the slider sleeve to selectively actuate rotary drive to the spindle (4).

Figure 2:
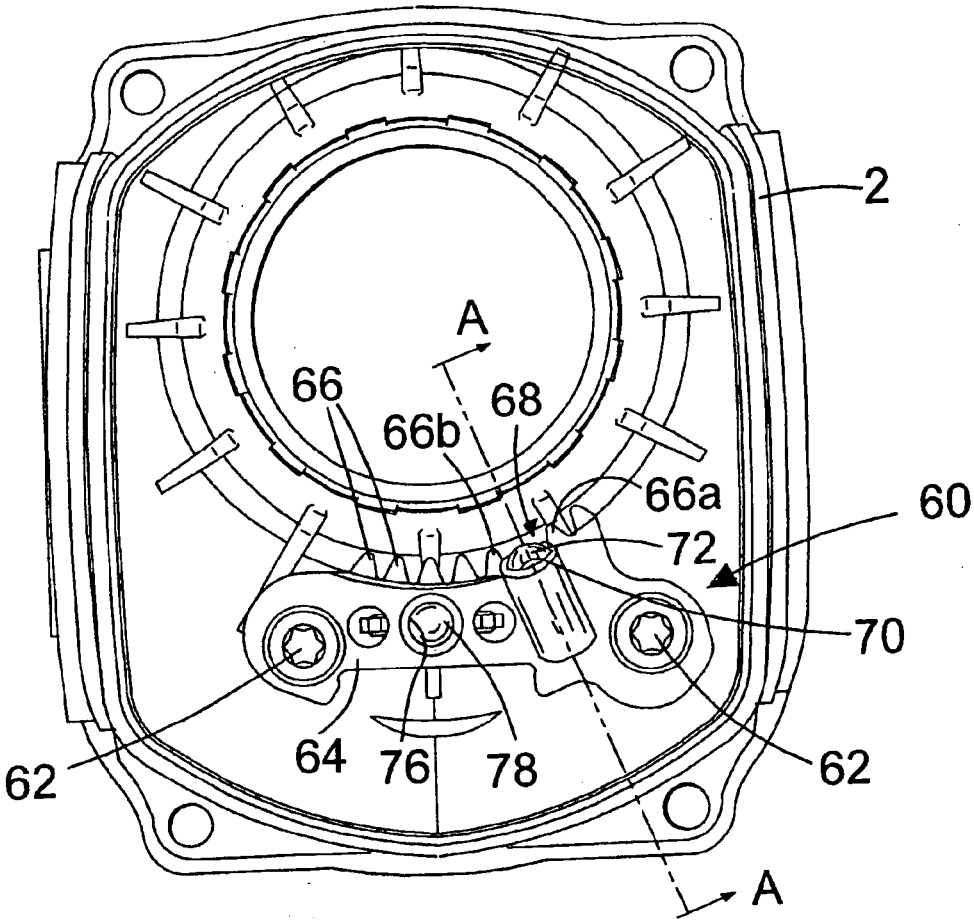
FIG. 2 shows the inside of the housing of the hammer of FIG. 1, viewed from the rear of the housing and with a first embodiment of a spindle lock arrangement fixed in the housing.
Figure 3:
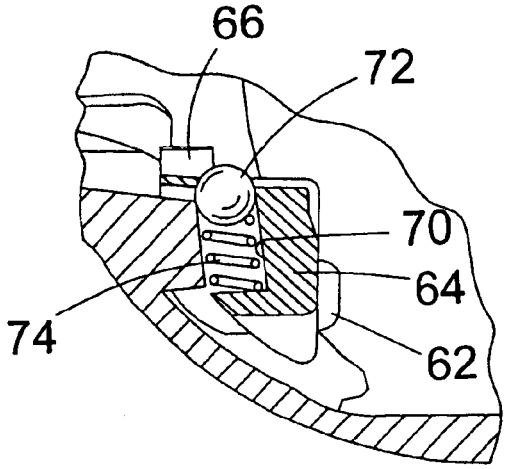
FIG. 3 shows a cross-section of a part of the hammer of FIGS. 1 and 2 taken along line AA of FIG. 2.

A first embodiment of the spindle lock arrangement is shown in FIGS. 2 and 3 and is fixed within the hammer housing (2) in the position shown in FIG. 1, at the forward end of the intermediate shaft (6), for example using a pair of screws (62). The screws pass through receiving holes in body (64) of the spindle lock arrangement and are received in cooperating screw bosses formed in the hammer housing (2). The body (64) is formed with a set of spindle lock teeth (66) formed in an arc in order to cooperate with the teeth (43) around the periphery of the spindle drive gear (40). A gap (68) is formed between two of the teeth (66*a*, 66*b*) in the arc of teeth, so that the width of the gap is double the size of the spacing between the other teeth (66), ie. large enough to accommodate an additional tooth at the existing tooth spacing. Rearwardly of the gap (68) there is formed a cylindrical recess (70) in the body (64) of the spindle lock arrangement. The recess extends in a radial direction with respect to the spindle (4). Within the recess (70) is located a synchronising ball (72) which is positioned so as to be aligned with the centre of the gap (68), ie. so as to be centred on the position that said additional tooth would take. A compression spring (74) biases the synchronising ball (72) out of the recess (70), which spring extends between the base of the recess (70) and the side of the ball facing into the recess (70). The entrance to the cylindrical recess (70) is of reduced diameter compared to the main portion of the recess so as to retain the synchronising ball within the recess (70).

When the slider sleeve (41) is moved forwardly against the biasing force of the spring (56) by the mode change mechanism (55, 57) the spindle drive gear (40) moves towards the spindle lock arrangement (60). If the set of teeth (43) around the periphery of the spindle drive gear are not in alignment with the set of spindle lock teeth (66), then the synchronising ball (72) engages between a pair of the teeth (43) to align the set of teeth (43) with the set of teeth (66) of the spindle lock arrangement. If the teeth are mis-aligned then, one of the pair of teeth (43) will initially engage the synchronising ball (72) tending to urge it further into the recess (70) against the biasing force of the spring (74). The spring (74) will act to urge the synchronising ball (72) out of the recess. To facilitate the synchronisation of the set of teeth (43) by engagement with the synchronising ball (72) the teeth are preferably chamfered. The teeth (43) are chamfered so that they taper to a reduced width towards their ends. The chamfering of the teeth (43) results in adjacent teeth having facing surfaces that slope away from each other. Due to the chamfering of the teeth (43) the ball (72) will cause the spindle drive gear (40) to rotate until the ball (72) lies centred between the pair of teeth. With the ball (72) centred between a pair of the teeth (43), the teeth (43) are aligned with the spindle lock teeth (66). Thus, further forward movement of the spindle drive gear (40) brings the teeth (43) of the spindle drive gear (40) into exact engagement with the teeth (66) of the spindle lock arrangement (66) in order to lock the spindle drive gear (40) and thus the spindle (4) against rotation.

Figure 4:
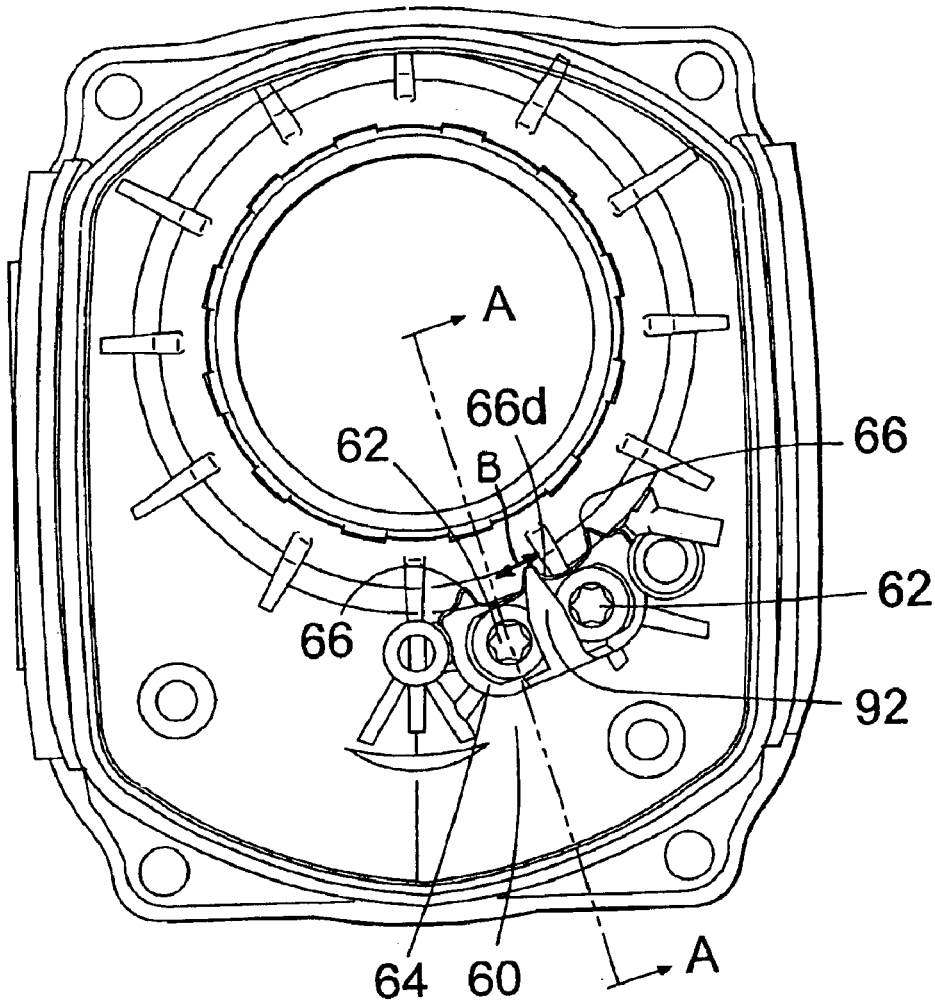
FIG. 4 shows the inside of the housing of the hammer of FIG. 1, viewed from the rear of the housing and with a second embodiment of a spindle lock arrangement fixed in the housing.
Figure 5:
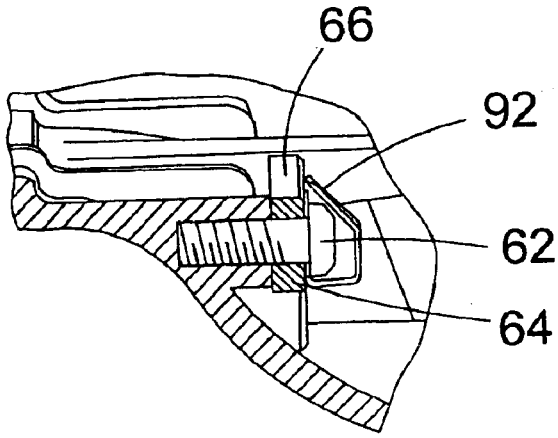
FIG. 5 shows a cross-section of a part of the hammer of FIGS. 1 and 4 taken along line AA of FIG. 2.

A second embodiment of the spindle lock arrangement is shown in FIGS. 3 and 4 and is fixed within the hammer housing (2) in the position shown in FIG. 1, at the forward end of the intermediate shaft (6), for example using a pair of screws (62). The body (64) is formed with a set of three spindle lock teeth (66, 66*d*) formed in an arc in order to cooperate with the teeth (43) around the periphery of the spindle drive gear (40). A punched metal part is fitted to the main body (64) via the pair of screws (62). The punched metal part, for example made out of spring steel, includes a base portion within which a pair of holes are formed through which the screws (62) pass and an extended portion which is bent rearwardly of the base portion and then is bent upwardly and forwardly, as shown in FIG. 5 to form a resilient synchronising arm (92). The resilient arm (92) tapers to a point at its end remote from the base of the punched metal part. The punched metal part is mounted on the main body (64) so that the arm (92) is located directly rearwardly of a central tooth (66*d*) of the set of three teeth (66). Due to the material from which the punched metal part is made and the configuration of the arm (92) with respect to the base of the punched metal part, the arm can be elastically deformed so that it moves laterally in the directions of the double arrows (B) in FIG. 4.

When the slider sleeve (41) is moved forwardly against the biasing force of the spring (56) by the mode change mechanism (55, 57) the spindle drive gear (40) moves towards the spindle lock arrangement (60). If the set of teeth

(43) around the periphery of the spindle drive gear are not in alignment with the spindle lock teeth (66), then the resilient arm (92) of the punched metal part engages between a pair of the teeth (43) to align the set of teeth (43) with the teeth (66) of the spindle lock arrangement. If the teeth are mis-aligned then, one of the pair of teeth (43) will initially engage the resilient synchronising arm (92) and deforms it in one direction of the arrow (B). The resilient synchronising arm will then be biased, under its own resilience, to assume its original position, as shown in FIG. 4. Due to the chamfering of the teeth (43) the resilient arm (92) will cause the spindle drive gear (40) to rotate until the arm (92) lies directly in front of the central tooth (66*d*) of the teeth (66). With the arm (92) centred on the tooth (66*d*), the set of teeth (43) are aligned with the spindle lock teeth (66). Thus, further forward movement of the spindle drive gear (40) brings the teeth (43) of the spindle drive gear (40) into exact engagement with the teeth (66) of the spindle lock arrangement (66) in order to lock the spindle drive gear (40) and thus the spindle (4) against rotation.

The spindle lock arrangement (60) is suitable for use on rotary hammers for facilitating mode change into hammer only mode with locked spindle, as described above. The spindle lock arrangement (60) is also useful on hammers, with no rotary modes, which have a hammering mode in which the spindle is free to rotate with respect to the hammer housing and a hammering mode in which the spindle is rotationally locked with respect to the hammer housing. The spindle lock arrangement is then suitable for facilitating mode change into the hammer mode with the spindle locked.

An arrangement for axially biasing the intermediate shaft (6) rearwardly can also be formed in the body (64) of the spindle lock arrangement. In particular where the drive to the hammering mechanism is a wobble drive arrangement, as is known in the art, the intermediate shaft can experience axial vibration, which can be damped by axially biasing the intermediate shaft (6) rearwardly, as is well known in the art. As shown in FIGS. 1 and 2, a rearwardly facing second recess (76) is formed in the body (64) extending substantially co-axially with the intermediate shaft (6) and substantially perpendicular to the direction in which the recess for the synchronising ball (72) extends. Within the second recess (76) is located a biasing ball (78) which is positioned so as to extend towards the intermediate shaft. A compression spring (80) biases the biasing ball (78) out of the recess (76), which spring extends between the base of the recess (76) and the side of the ball facing into the recess). The entrance to the cylindrical recess (76) is of reduced diameter compared to the main portion of the recess so as to retain the biasing ball (78) within the recess (70).

The intermediate shaft (6) is mounted within a pair of bearings, the rearward of which is press-fit into the housing (2) and the forward of which (3) is shown in FIG. 1. At the forward end of the intermediate shaft (6) is formed an axially extending recess (81) for receiving a guiding pin (82) so that the pin (82) is free to rotate with respect to the intermediate shaft (6). The forward end of the pin (82) is concave and engages the biasing ball (78). The spring (80) thus axially biases the intermediate shaft (6) rearwardly via the biasing bal (78) and the pin (82).

What is claimed is:

1. A hand-held powered hammer comprising:

a hammer housing;

a hammering mechanism;

a spindle rotatably mounted within the housing; the spindle having at least two selectable modes of operation including a first mode in which the spindle is rotatable within the housing and a second mode in which the spindle is restrained from rotation;

a first set of teeth rotatable with the spindle and selectably movable between a first position, corresponding to the first mode of operation of the spindle, and a second position, corresponding to the second mode of operation of the spindle;

a spindle lock arrangement mounted within the housing and comprising a spindle lock tooth engageable with the first set of teeth when the first set of teeth are in the second position, and a resilient synchronising element positioned to engage the first set of teeth before the first set of teeth reaches the second position, so as to align the first set of teeth for engagement with the spindle lock tooth when the first set of teeth are in the second position.

2. A hammer according to claim 1 wherein the set of teeth are chamfered so that they taper to a reduced width.

3. A hammer according to claim 2 wherein the set of teeth are chamfered so that adjacent teeth include facing surfaces which slope away from each other.

4. A hammer according to claim 1 wherein the synchronising element is positioned in axial alignment with the spindle lock tooth.

5. A hammer according to claim 1 wherein the spindle lock tooth is a first spindle lock tooth and the spindle lock arrangement includes a second spindle lock tooth and a gap located between the first spindle lock tooth and the second spindle lock tooth, and wherein the synchronising element is positioned in axial alignment with the gap.

6. A hammer according to claim 1 wherein the first set of teeth are formed on a gear and the gear is mounted around the spindle.

7. A hammer according to claim 6 and further comprising an overload clutch arrangement drivably connectable between the first set of teeth and the spindle.

8. A hammer according to claim 1 and further comprising a gear train mounted in the housing and engaged with the first set of teeth when the first set of teeth are in the first position.

9. A hammer according to claim 1 wherein the first set of teeth is axially slideably moveable into engagement with the spindle lock tooth.

10. A hammer according to claim 1 wherein the synchronising element includes an engaging element slideably mounted on the spindle lock arrangement and a spring element for biasing the engaging element into an engaged position in which engaged position the engaging element is engageable with the set of teeth.

11. A hammer according to claim 10 wherein the spindle lock arrangement defines a recess with an opening, the spring and the engaging element are located within the recess and the spring biases the engaging element into a position in which the engaging element protrudes from the entrance to the recess.

12. A hammer according to claim 10 wherein the engaging element is a ball.

13. A hammer according to claim 10 and further including an intermediate shaft and wherein the spindle lock arrangement is located at the forward end of the shaft and the spindle lock arrangement includes a biasing assembly that biases the intermediate shaft rearwardly within the housing.

14. A hammer according to claim 13 wherein the biasing assembly for the intermediate shaft includes a resilient element positioned to engage the forward end of the intermediate shaft.

15. A hammer according to claim 14 wherein the resilient element acts to bias the intermediate shaft in a direction substantially perpendicular to the direction in which the engaging element acts to engage the first set of teeth.

16. A hammer according to claim 1 wherein the synchronising element is a resilient arm engageable with and laterally deflectable by the first set of teeth.

* * * * *